US005931265A

United States Patent [19]

Hollowell et al.

[11] Patent Number: 5,931,265

[45] Date of Patent: Aug. 3, 1999

[54] ROPE CLIMBING ELEVATOR

[75] Inventors: Richard L. Hollowell, Paris, France; Samuel C. Wan, Simsbury, Conn.

[73] Assignee: Otis Elevator Company, Farmington, Conn.

[21] Appl. No.: 08/825,282

[22] Filed: Mar. 27, 1997

[51] Int. Cl.[6] ..... B66B 11/08; B66B 7/06

[52] U.S. Cl. ..... 187/407; 187/249; 187/254; 187/256; 187/258; 254/389

[58] Field of Search ..... 198/407, 249, 198/250, 251, 254, 256, 258, 259, 264, 266, 411, 414; 254/278, 287, 389

[56] References Cited

U.S. PATENT DOCUMENTS

| | | | |
|---|---|---|---|
| 610,256 | 9/1898 | Brown | 187/407 |
| 691,276 | 1/1902 | Kuttgen | 187/256 |
| 921,646 | 5/1909 | Larson | 187/258 |
| 1,237,321 | 8/1917 | Fraser | 187/256 |
| 1,750,237 | 3/1930 | Mayer | 187/258 |
| 1,974,361 | 9/1934 | Le Neve | 187/256 |
| 2,405,691 | 8/1946 | Ellis | 187/256 |
| 3,127,957 | 4/1964 | Nelson | 187/256 |
| 4,402,386 | 9/1983 | Ficheux et al. | 187/289 |
| 4,502,570 | 3/1985 | Westerlund | 187/264 |
| 4,756,388 | 7/1988 | Heikkinen | 187/256 |
| 4,949,815 | 8/1990 | Pavoz | 187/404 |
| 5,370,205 | 12/1994 | Vanhala | 187/264 |
| 5,419,414 | 5/1995 | Sakita | 187/249 |
| 5,636,712 | 6/1997 | Muller et al. | 187/249 |

FOREIGN PATENT DOCUMENTS

0565516A1 4/1993 European Pat. Off. .

*Primary Examiner*—Christopher P. Ellis
*Assistant Examiner*—Thuy V. Tran

[57] ABSTRACT

A rope climbing elevator (10) includes prime movers (40, 42) and drive sheaves (32,34) secured to the car (10) and engaging stationary ropes (12–26).

12 Claims, 3 Drawing Sheets

FIG.7
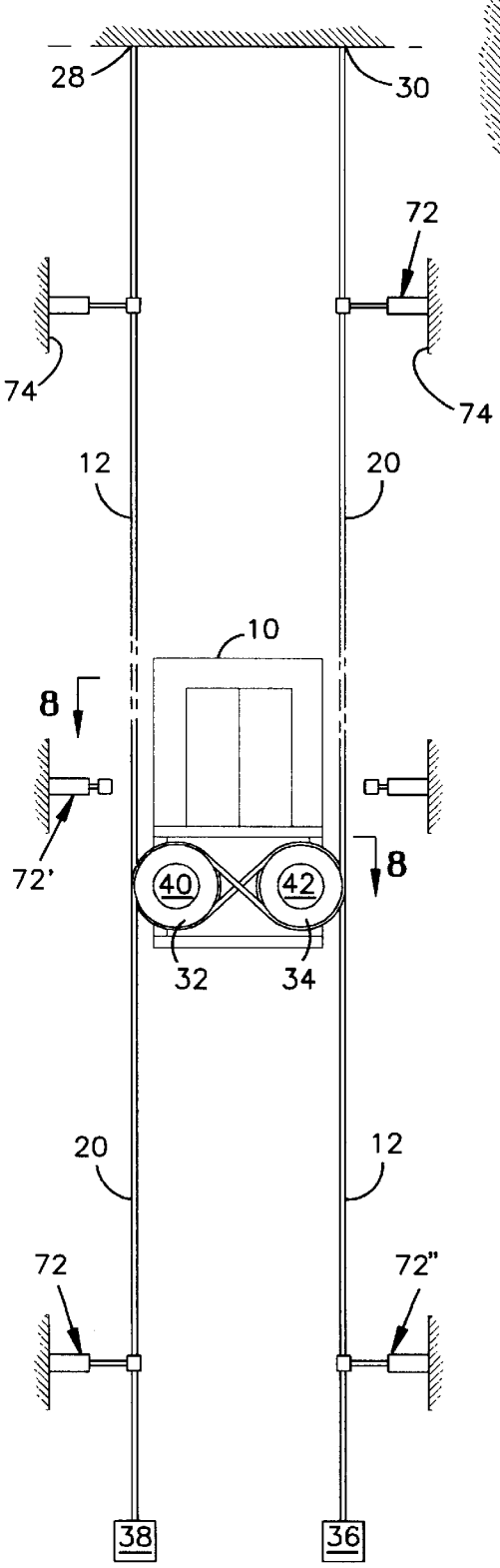
FIG.8
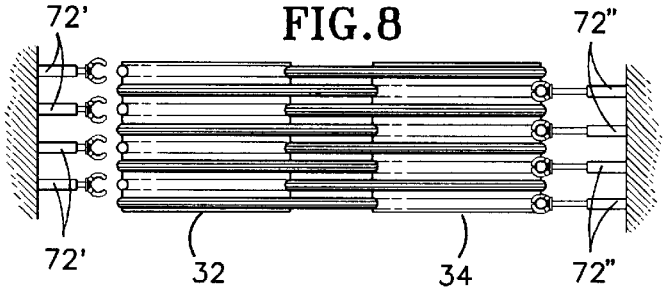
FIG.9A
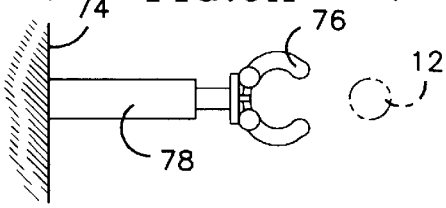
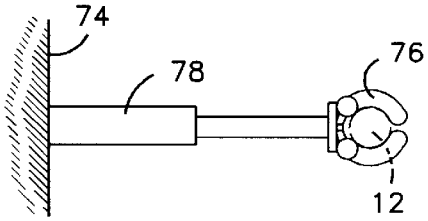
FIG.9B
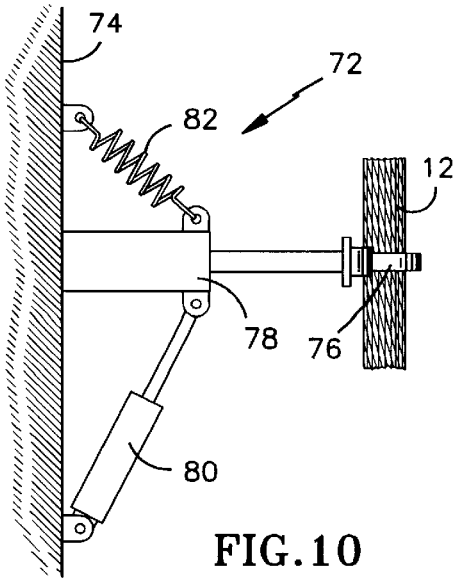
FIG.10

ROPE CLIMBING ELEVATOR

TECHNICAL FIELD

The present invention relates to a rope climbing elevator.

BACKGROUND OF THE INVENTION

Typical roped or hydraulic elevators in current use consist of a cab which is moved vertically within a hoistway shaft by means of an external mechanism, such as a traction machine for roped elevators and an hydraulic piston and pump for hydraulic elevators. The location of the machinery associated with such external hoisting machines can be problematic in certain types and arrangements and buildings.

Designers have attempted to address the these problems by proposing self-propelled elevators in which the lifting mechanism is integral with the elevator car, thus avoiding the need for a machine room or other designated space to house the elevator lifting machinery. Various prior art designs have utilized rack and pinion arrangements in which a geared pinion on the elevator car engages a linear rack disposed vertically in the hoistway, linear induction motors wherein the primary and secondary armatures are disposed on the elevator car and hoistway, respectively, and other means which will readily occur to those skilled in the art. Each has various drawbacks in terms of speed, power consumption, ride quality, etc., and none have achieved wide-spread acceptance or use.

DISCLOSURE OF THE INVENTION

It is an object of the present invention to provide a self-propelled, rope climbing elevator.

According to the present invention, an elevator car is provided with at least one pair of counter-rotating traction sheaves which are driven by one or more prime movers which are also secured to the car. Each sheave receives a corresponding stationary rope, secured at the upper end of the elevator hoistway, and hanging vertically downward. Each rope is wrapped partially about the lower portion of its corresponding sheave, and partially about the upper portion of the other paired sheave, hanging vertically downward therefrom. The lower, or free, end of each rope is then tensioned by a suspended weight, spring or the like.

In operation, the driven traction sheaves rotate, causing the car to move vertically within the hoistway by translating the cab relative to the stationary ropes.

In a second embodiment of the present invention, a second elevator car is operable within at least a portion of the hoistway traversed by the first car. The respective ropes and sheave pairs are located so as to avoid interference between the cars during operation, thus allowing the two cars to run simultaneously in the same hoistway.

In a third embodiment of the present invention, the hoistway includes a plurality of rope clamps adapted to engage the stationary ropes and support a portion of their weight, particularly in high-rise applications in which the length and weight of the rope is very great. The clamps release upon approach of the car and are re-engaged after the car passes. By providing intermediate support of the rope, the clamps permit use of very long ropes which would otherwise not be suitable in this application.

BRIEF DESCRIPTION OF THE DRAWINGS

FIG. 7 shows a third embodiment of the present invention having a plurality of rope clamping means shown in FIGS. 8, 9*a*, 9*b* and 10.

BEST MODE FOR CARRYING OUT THE INVENTION

Figure 1:
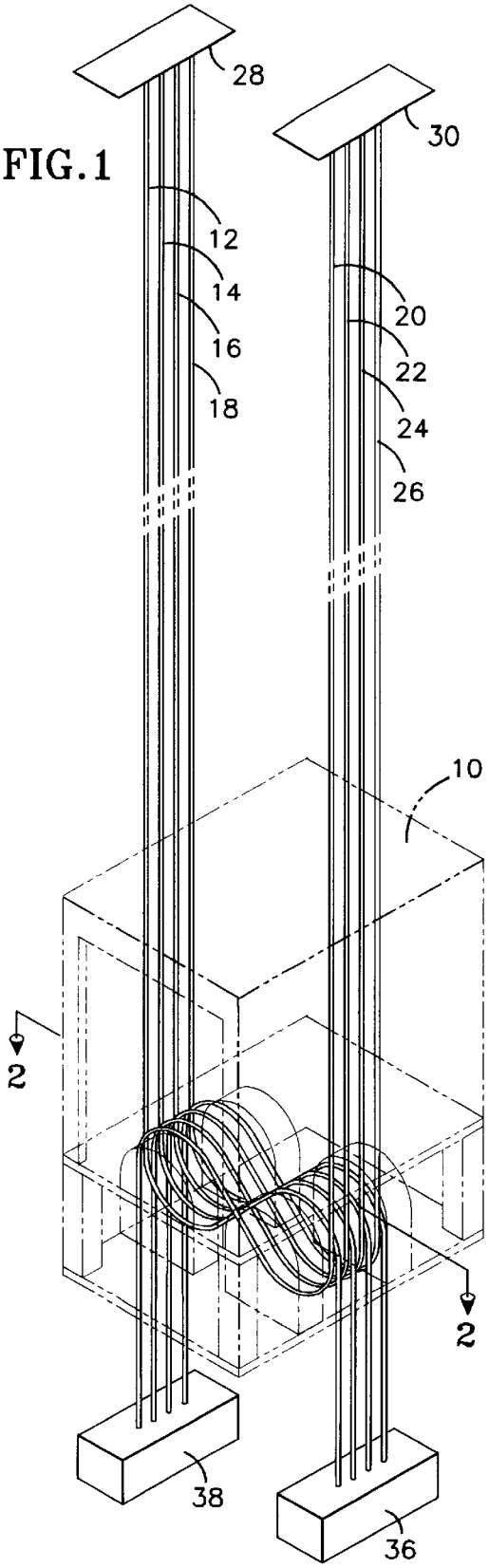
FIG. 1 shows an embodiment of the present invention without the surrounding hoistway.

Referring now to the drawing Figures, and in particular to FIG. 1, a first embodiment according to the present invention will be described in detail. FIG. 1 shows an elevator car 10 disposed within a hoistway shaft (not shown). A plurality of vertical ropes 12–26 hang in two groups of four vertically downward from upper securing points 28,30. The ropes engage counter rotating paired drive sheaves 32,34 disposed, in this embodiment beneath the elevator car 10 in a manner as will be further described. Each group of ropes 12–18 and 20–26 terminate at their lower vertical ends at respective weights 36,38 or other tensioning means, including springs, hydraulic actuators, electromagnetic actuators or any other means well known in the art for imparting a tensile force a rope.

Figure 2:
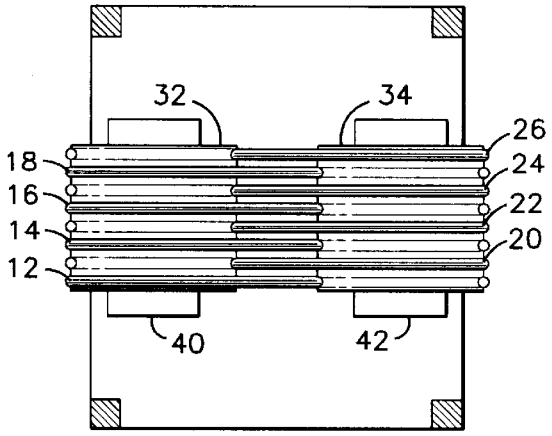
FIG. 2 shows a more detailed plan view of the sheave arrangement as shown in FIG. 1.
Figure 3:
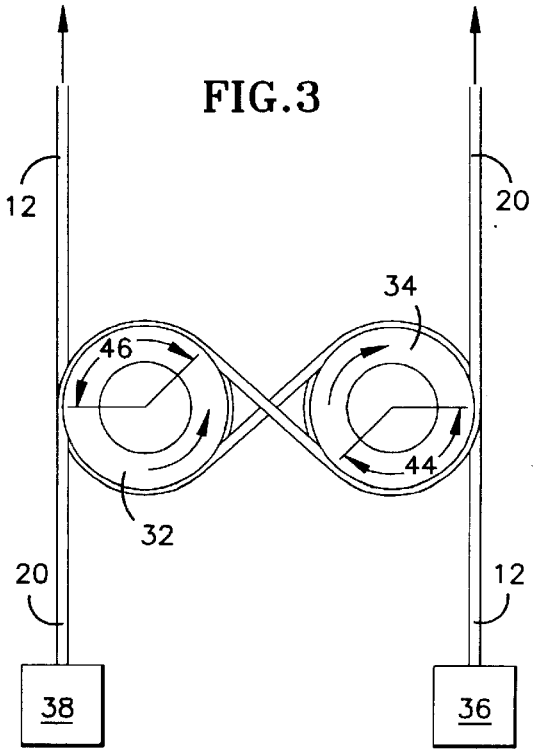
FIG. 3 shows a side elevation of the sheave arrangement according to the present invention.

Referring now particular to FIGS. 2 and 3, the operation of a rope climbing elevator according to the present invention may be described. Drive sheaves 32,34 are driven in opposite directions by prime movers 40,42, respectively. As shown in FIG. 3, rope 20, hanging vertically downward within the hoistway shaft (not shown) and outside of the travel volume of the elevator car 10, passes underneath drive sheave 34, turning laterally and vertically upward to pass over drive sheave 32, turning again vertically downward and terminating at tensioning weight 38 in the lower portion of the hoistway shaft. In describing this path, rope 20 engages a substantial arc 44 on the lower portion of sheave 34 and a similar size arc 46 on the upper portion of drive sheave 32. The substantial engagement arc with the drive sheaves 32,34, coupled with the tension provided in rope 20 by means of that portion hanging vertically downward from drive sheave 32 as well as any tension force provided by the tension means 38, allow the sheave and rope system shown in FIGS. 1–3 to achieve sufficient traction to cause the counter rotation of sheaves 32,34 to drive the elevator vertically upward or downward as desired. As will be appreciated by those skilled in the art, ropes 12–18 and 22–26 shown in FIGS. 1 and 2 each engage corresponding upper and lower portions of drive sheaves 32,34 as described for rope 20 above.

Prime movers 40,42 are shown schematically and are representative of any of a number of well known means for imparting controllable counter rotation to sheaves 32,34 with sufficient power to lift the elevator car 10 and its contents in the manner described. As such, the prime mover or prime movers may be powered by electricity, and coupled to the sheaves either mechanically by means of gears, chains, belts, or the like, hydraulically or directly, depending upon the required power, or other application specific parameters. Although it is believed preferable, due to load balancing, torque balancing, smoothness, and other consideration, that both sheaves 32,34 be driven in a counter-rotating direction, the elevator arrangement according to the present invention is operable using only one driven sheave with the other sheave serving as an idler.

Power may be supplied to the moving car 10 and driving means 40,42 by means of any of a number of arrangements well known and used currently in the art, including vertically oriented electrical bus bars disposed on the hoistway wall and moving contacts disposed on the elevator car, a traveling cable running between the car and a power connection point on the elevator wall, etc.

The embodiment as described above and shown in FIGS. 1–3 permits the elevator car 10 to operate vertically without the need for a separate machine room in an extended overhead space (not shown) or in a lower pit area (not shown). Further, the arrangement as shown and described does not require a moving counterweight or other similar arrangement to tension the ropes passing over the drive sheaves thereby avoiding the need to provide additional space within the hoistway to accommodate the vertically moving counterweight. As such, elevator systems according to the present invention may be particularly well suited for older or modern buildings for which there is a need to provide elevator service while accommodating limitations on the amount of space available for use. Alternatively, the use of a separately roped counterweight arrangement, (not shown) may be used to reduce the prime mover power requirement.

As will be further appreciated by those skilled in the art, the arrangement according to the present invention will permit the elevator prime mover 40,42, or machine, the motor drive (not shown) and controller (not shown) to be packaged, thus reducing shipping and installation time and cost.

Figure 4:
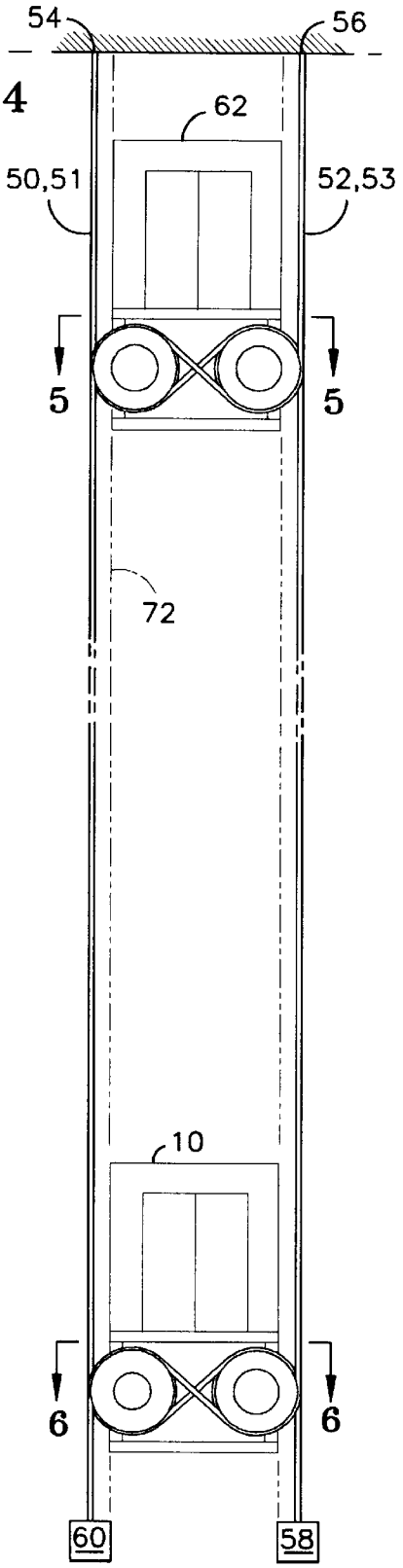
FIG. 4 shows a side elevation of the second embodiment of the present invention.
Figure 5:
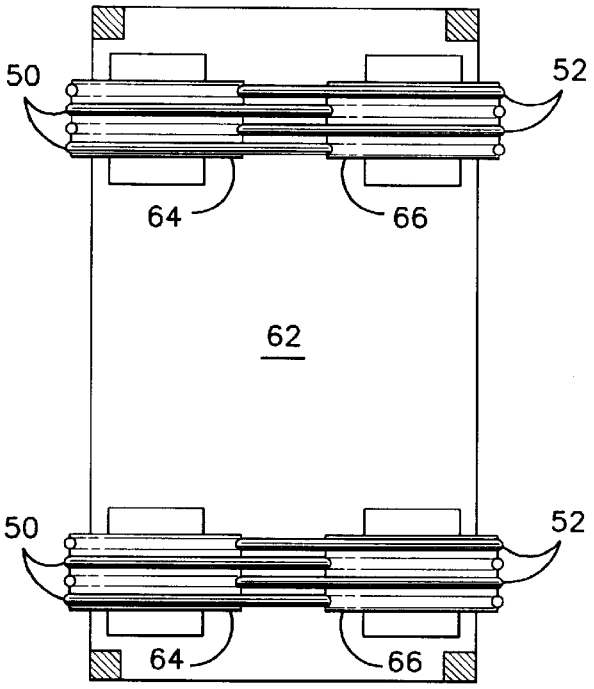
FIGS. 5 and 6 show respective plan views of the sheave arrangement of the first and second elevator cars of FIG. 4.
Figure 6:
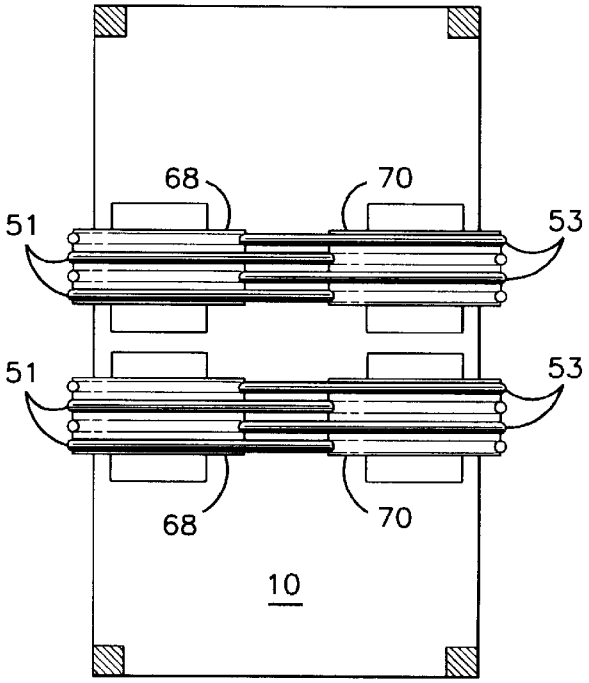

FIGS. 4–6 show a second embodiment of the elevator system according to the present invention. As in the first embodiment, FIG. 4 shows a plurality of stationary ropes disposed in two groups 50,52 secured at their respective upper ends 54,56 and hanging vertically downward, terminating at the lower ends with respective tensioning means 58,60. In addition to the first car 10, however, this second embodiment includes a second car 62 which is operable within at least a portion of the vertical travel elevator of the first car 10 as described below.

As may be viewed clearly in FIGS. 5 and 6, cars 62 and 10 each include counter-rotating drive sheaves 64,66 and 70, respectively. The counter-rotating sheaves 64,66 of the upper car 62 each first engage respective groups of ropes 50,52 as described for the first embodiment.

With regard to car 10, drive sheave pairs 68,70 likewise engage opposite rope groups 51,53 disposed laterally outside of the travel volume of the elevator cars 10,62 and adjacent ropes 50,52 engaged by car 62.

The operation of the second embodiment according to the present invention may now be understood. Elevator cars 10,62 may each simultaneously occupy a position within a shared travel volume 72 each servicing the same floor via the same hoistway shaft and doors. As each car contains an independent prime mover, and as the shared vertical travel zone 72 is unoccupied by any central ropes or other impediments, the elevators are constrained, in this embodiment, only by the restriction that they are unable to pass each other in the vertical direction. Vertical tensioning means 58,60 shown in FIG. 4 comprise a plurality of individual weights, secured to each rope or group of ropes, or individual spring or hydraulic tensioning members as discussed herein.

The flexibility of the second embodiment according to the present invention, provides increased flexibility, load capacity and other features in a single vertical hoistway. For extremely high-rise applications, transfer between banks of elevators in a sky lobby or other transfer arrangement may be accomplished by exiting a car traversing, for example, a lower range of floors and reentering, via the same lobby door, an elevator car servicing an upper range of floors. Other possibilities include, for example, dispatching an express elevator from an entrance level floor during a peak period which operates non-stop to an upper floor, while providing a local elevator car, at the same lobby entrance to follow servicing intermediate lower floors. These and other arrangements and advantages will become obvious to those skilled in the art having appreciated the flexibility and functionality provided by elevator system according to the present invention.

FIGS. 7–10 illustrate a third embodiment of an elevator system according to the present invention which is particularly adapted for ultra high-rise buildings. Extremely high-rise buildings serviced by roped elevators face a limitation due to the physical characteristics of the steel elevator ropes commonly used. Conventional steel ropes, regardless of their design, become unsuitable in applications wherein the elevator range of travel is over 300 meters. At such lengths, the freely hanging steel rope becomes unable to bear its own weight and that of the car. The third embodiment of the present invention takes advantage of the fact that the elevator system according to the invention utilizes only stationary ropes to address this problem.

FIG. 7 shows an elevator car 10, primarily as described and shown in FIG. 1, having drive sheaves 32,34 and prime movers 40,42 engaging stationary ropes 12,20. For the purposes of illustration, only ropes 12 and 20 will be discussed, however, it will be appreciated that multiple ropes as shown in the preceding embodiments may be utilized as necessary. Ropes 12,20 are secured at their upper ends at stationary points 28,30 and tensioned as necessary at their lower ends by weights or other tensioning means 36,38. The third embodiment provides means for supporting the vertical stationary ropes 12,20 particularly wherein the unsupported rope may be in danger of failing under its own weight. This is accomplished in the embodiment of FIG. 7 by means of a plurality of clamping means shown secured vertically to the building structure such as the hoistway wall 74. The clamps are retractable between an extended engaged condition, as shown in FIG. 9*b* wherein a releasable clamp 76 engages the rope 12 and a retracted, released position as shown in FIG. 9*a* wherein the clamp 76 is released and retracted toward the hoistway wall 74. Retraction may be accomplished by a number of well known means, including an hydraulic or electric actuator 78 as shown in the Figures. The support means 72 are shown disposed at one or more locations vertically along the hoistway 74 spaced vertically as required to provide intermediate support of the ropes 12,20 between the upper attachment points 28,30 and the lower tensioned ends.

As will be appreciated by viewing FIG. 7, as elevator car 10 traverses vertically through the hoistway 74, clamps 72 are released upon approach of the car thereby freeing ropes 12,20 for engagement by the drive sheaves 32,34, and reengaged upon passing of the car 10 to provide intermediate vertical support. FIG. 8 shows a first series of clamps 72' which are disengaged due to the proximity of the car 10, and a second group of clamps 72" which will be reengaged following the passage of the car vertically upward. FIG. 10 shows a schematic of a support means as may be used in an elevator system according to this embodiment of the invention. As noted above, the device includes a releasable rope engaging clamp 76, a retracting means 78 secured to the hoistway wall 74, and a variable supporting actuator 80 for providing the necessary vertical supporting an equalizing force to the rope 12 so as to provide the necessary intermediate support to avoid excessive tensile stress. The equalizing force is preferable equal to the weight of the rope segment between adjacent rope clamps 76. The embodiment in FIG. 10 also shows a spring or other tensioning means 82 provided here as a biasing means for optimizing the delivery of vertical supporting force to the rope 12 via the clamp 76. It may be appreciated that, under certain conditions, it may be desirable to monitor the actual tensile stress in the rope 12 and operate the support force actuators 80 accordingly.

It will further be appreciated upon a review of the second and third embodiments, that the elevator system according to the third embodiment is likewise easily adapted to the operation of one or more additional elevator cars within the same travel range.

Likewise, the location of the driving sheaves and prime movers on the upper portion of the elevator car, as well as the use of double deck cars, or the like, should also be appreciated as being within the scope of the invention, which has been disclosed herein an exemplary, and not exhaustive, manner.

Various changes to the above description may be made without departing from the spirit and scope of the present invention as would be obvious to one of ordinary skill in the art of the present invention.

What is claimed is:

1. An elevator system comprising:

a vertical hoistway;

an elevator car, disposed within said hoistway, including first and second spaced apart sheaves having parallel axes of rotation;

a first and a second rope, each rope extending vertically in the hoistway through a range of travel of said car, each rope secured at a vertically upward end thereof, wherein said first rope passes laterally under said first sheave, vertically upward between said first and second sheaves, and laterally over said second sheave, said second rope passes laterally under said second sheave, vertically upward between said second and first sheaves, and laterally over said first sheave, and wherein said car further includes means for driving one of said first and second sheaves.

2. The elevator system as recited in claim 1, wherein said ropes are disposed at the periphery of said hoistway and outside the volume traversed by said car.

3. The elevator system as recited in claim 1, wherein said first and second sheaves include first and second corresponding circumferential grooves, each groove receiving a corresponding first and second rope.

4. The elevator system as recited in claim 1, wherein the lower vertical end of each first and second rope is secured to a means for tensioning said corresponding rope.

5. The elevator system as recited in claim 4, wherein the tensioning means is a suspended weight.

6. The elevator system as recited in claim 4, wherein the tensioning means is a spring.

7. The elevator system as recited in claim 4, wherein the tensioning means is a means for imparting a variable tensile force on said rope.

8. The elevator system as recited in claim 1, further comprising:

a second car, disposed vertically above the first car in said hoistway and having a second range of travel within said hoistway, said car including third and forth spaced apart sheaves having parallel axes of rotation, a third and forth rope, each rope extending vertically in the hoistway through a range of travel of said second car, each third and forth rope secure at a vertically upward end thereof wherein said third rope passes under said third sheave, vertically upward between said third and forth sheaves, and laterally over said forth sheave, said forth rope passes under said forth sheave vertically upward between said forth sheave and said third sheaves, and laterally over said third sheave, and wherein said second car further includes means for driving one of said third and forth sheaves.

9. The elevator system as recited in claim 8, wherein the range of travel of the second car overlaps the range of travel of the first car.

10. The elevator system as recited in claim 1, further comprising:

a plurality of means for clamping said first and second ropes, said means disposed vertically along the hoistway, said rope clamping means being selectively releasable upon approach of said car and securable upon passing of said car.

11. The elevator system as recited in claim 10, wherein the rope claim means includes means for tensioning and supporting the clamped rope within a range of acceptable rope tension.

12. The elevator system as recited in claim 11, wherein said hoistway is in excess of 300 meters and said ropes are made of steel.

* * * * *